US011166528B2

(12) United States Patent
Ozawa et al.

(10) Patent No.: US 11,166,528 B2
(45) Date of Patent: Nov. 9, 2021

(54) SLIDER AND SLIDE FASTENER WITH SAME

(71) Applicant: YKK Corporation, Tokyo (JP)

(72) Inventors: Takanori Ozawa, Kurobe (JP); Takayuki Inukai, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/045,878

(22) PCT Filed: Apr. 9, 2018

(86) PCT No.: PCT/JP2018/014838
§ 371 (c)(1),
(2) Date: Oct. 7, 2020

(87) PCT Pub. No.: WO2019/198118
PCT Pub. Date: Oct. 17, 2019

(65) Prior Publication Data
US 2021/0137223 A1 May 13, 2021

(51) Int. Cl.
*A44B 19/26* (2006.01)

(52) U.S. Cl.
CPC ..... *A44B 19/26* (2013.01)

(58) Field of Classification Search
CPC ..... A44B 19/26; A44B 19/262
See application file for complete search history.

(56) References Cited

U.S. PATENT DOCUMENTS 5,152,036 A * 10/1992 Oda ..... A44B 19/308 24/424
2005/0102803 A1* 5/2005 Wen ..... A44B 19/26 24/415

FOREIGN PATENT DOCUMENTS

| | | | |
|---|---|---|---|
| JP | S63-17609 | U | 2/1988 |
| JP | H03-295502 | A | 12/1991 |
| JP | H07-313216 | A | 12/1995 |
| JP | H09-294612 | A | 11/1997 |
| JP | 2003-210211 | A | 7/2003 |
| JP | 2017-185216 | A | 10/2017 |
| WO | 2008/081471 | A2 | 7/2008 |

OTHER PUBLICATIONS

International Preliminary Report on Patentability, PCT Patent Application No. PCT/JP2018/014838, dated Oct. 13, 2020.
International Search Report, PCT Patent Application No. PCT/JP2018/014838, dated Jun. 19, 2018.
Written Opinion, PCT Patent Application No. PCT/JP2018/014838, dated Jun. 19, 2018.
Office Action, Taiwanese Patent Application No. 107130078, dated Feb. 14, 2019.

* cited by examiner

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A slider includes a resin-made slider body, a pull tab, and a metallic connecting pin. Lateral walls of the slider body and the pull tab are provided with shaft holes in which the connecting pin is inserted. The shaft holes of the lateral walls are opened on outer side surfaces of the lateral walls to define openings, a bottom edge point of each of the openings being located at a position outer in a Y-axis direction than a top edge point above the bottom edge point.

8 Claims, 10 Drawing Sheets

SLIDER AND SLIDE FASTENER WITH SAME

TECHNICAL FIELD

The present invention relates to a resin-made slider connecting a pair of fastener stringers and a slide fastener including the slider.

BACKGROUND ART

A typical slide fastener including a resin-made slider and a pair of fastener stringers connected by the slider has been known (see Patent Literature 1). The slider includes: a slider body; a pull portion (pull tab) pivotally supported by the slider body; and an elastic lock member attached to the slider body.

The slider body is provided with a pair of lateral walls projecting from widthwise sides of an upper surface of the slider body. The pull tab includes a shaft pivotally supported by the pair of lateral walls and a cam projection to be brought into contact with an elastic lock member when the pull tab is rotated. The elastic lock member, which is located at a position capable of being brought into contact with the cam projection of the pull tab to be raised in accordance with the rotation of the pull tab from a lock position (a position where the pull tab is laid along the upper surface of the slider body), is configured to elastically bias the pull tab to the lock position when being brought into contact with the cam projection to be bent.

Moreover, there has been known a slider assembly (slider) of a slide fastener, including the slider body and the pull tab connected to each other by a pivot pin (see Patent Literature 2). In this slider, the pivot pin is inserted through a pair of lateral walls formed on an upper vane of the slider body and a base end of the pull tab interposed between the pair of lateral walls. A diameter of the pivot pin is defined to be smaller than a diameter of the base end of the pull tab.

CITATION LIST

Patent Literature(S)

Patent Literature 1 International Publication WO 2008/081471

Patent Literature 2 JP 2017-185216 A

SUMMARY OF THE INVENTION

Problem(s) to be Solved by the Invention

In the slide fastener of Patent Literature 1, a shaft of the pull tab, which is configured to pivot on the slider body, is designed to have a large diameter to a certain extent in order to secure a strength required for the shaft. For this reason, it is difficult to reduce a thickness of the slider. Moreover, although it is conceivable to produce the slider body and the pull tab by integral molding or insert molding, a slide core, which has to be interposed between the slider body and the pull tab during the production process, requires a certain thickness for the slider.

Here, in order to reduce the thickness of the slider, it is conceivable to use a metallic connecting pin having a smaller diameter than the shaft of the pull tab described above. For instance, it is described in Patent Literature 2 that the pivot pin (connecting pin) of the slider has a smaller diameter than that of the base end of the pull tab. However, it takes time to position such a small-diameter pivot pin in inserting the pivot pin into the lateral wall of the slider body, which entails difficulty in improvement in the assemblability of the slider.

An object of the invention is to provide a resin-made slider capable of reducing a thickness thereof and improving assemblability thereof, and a slide fastener including the slider.

Means for Solving the Problem(s)

According to an aspect of the invention, a slider includes: a resin-made slider body including an upper surface and a pair of lateral walls projecting from the upper surface; a pull tab interposed between the pair of lateral walls in a width direction of the slider body in which the pair of lateral walls are opposed to each other; and a metallic connecting pin connecting the pull tab to the pair of lateral walls so that the pull tab is rotatable, in which the pull tab and at least one of the lateral walls each include a shaft hole that is provided along the width direction and in which the connecting pin is inserted, the shaft hole of the at least one of the lateral walls is opened on an outer side surface of the at least one of the lateral walls to define an opening, and the opening of the shaft hole is provided with a bottom edge point and a top edge point above the bottom edge point in a direction orthogonal to the width direction of the slider body, the bottom edge point being offset outward in the width direction with respect to the top edge point.

According to the above aspect of the invention, since the pull tab is rotatably connected to the resin-made slider body by the metallic connecting pin, as compared with an exemplary resin-made pull tab having a shaft supported by the slider body, the connecting pin having a smaller diameter than that of the shaft is usable, so that the thickness of the slider is reducible by the reduced amount in the diameter of the connecting pin.

Further, since the bottom edge point is at the outer position in the width direction than the top edge point in the shaft hole opened on the outer side surface as described above, the guide surface can be formed at an outer part in the width direction than the top edge point in the opened shaft hole. With this arrangement, by bringing the connecting pin into contact with the guide surface when inserting the connecting pin into the lateral wall, the connecting pin can be easily positioned with respect to the lateral wall, so that assemblability of the slider is improvable.

In the slider in the above arrangement, it is preferable that at least a part of the outer side surface of the at least one of the lateral walls is a concave curve whose center of curvature is located outside in the width direction with respect to the at least one of the lateral walls.

With this arrangement, for instance, as compared with a case where the outer side surface of the lateral wall is formed so as to be a convex curve, since a distance from the top edge point to the bottom edge point in the width direction becomes longer, a region in the width direction of the guide surface for guiding the connecting pin can be widened, so that insertability of the connecting pin is improvable.

In the slider in the above arrangement, it is preferable that the connecting pin is fixed to one of the pull tab and the pair of the lateral walls, and the other of the pull tab and the pair of the lateral walls is rotatably connected to the connecting pin.

With this arrangement, the connecting pin, which is fixed to one of the slider body and the pull tab and is rotatably connected to the other of the slider body and the pull tab, is prevented from dropping off and can rotate the pull tab with respect to the slider body.

In the slider in the above arrangement, it is preferable that the connecting pin is a hollow cylinder including a slit groove along an axial direction of the connecting pin, and a diameter of the shaft hole of each of the pair of lateral walls or a diameter of the shaft hole of the pull tab is smaller than a diameter of the connecting pin.

Since the slit groove is formed in this arrangement, the diameter of the connecting pin can be elastically reduced in the circumferential direction. Accordingly, the connecting pin, whose diameter is slightly larger than the shaft hole of the lateral wall of the slider body or the pull tab, can be prevented from dropping off by being inserted into the shaft hole with the diameter being reduced. Although the resin slider, unlike a metallic slider, cannot be caulked on the end of the connecting pin in order to be prevented from dropping off, the connecting pin provided with the slit groove as in the above aspect of the invention can be easily prevented from dropping off simply by being inserted into the shaft hole.

In the slider in the above arrangement, it is preferable that the shaft hole is formed in each of the pair of lateral walls, the shaft hole being located at a part of each of the pair of lateral walls where a height is at a maximum.

With this arrangement, while the height of each of the pair of lateral walls is restricted so as not to increase the thickness of the slider body, a strength required at the part of each of the pair of lateral walls where the shaft hole is formed can be reliably obtained.

In the slider in the above arrangement, it is preferable that the shaft hole is formed in each of the pair of lateral walls to define respective openings therein, at least one of the openings being closed by a melt part of the lateral walls.

With this arrangement, the connecting pin can be prevented from dropping off by the shaft hole thus closed with the melt part of the lateral wall(s). Since the shaft hole is closed by the melt part of the lateral wall(s), the shaft hole can be made less noticeable in appearance. In addition, the melt part is not differentiated from other parts in terms of a material, the part per se closing the shaft hole can also be made less noticeable in appearance, thereby improving design of the slider.

In the slider in the above arrangement, it is preferable that the shaft hole is formed in each of the pair of lateral walls, and the slider includes a cover member disposed in the shaft hole of at least one of the pair of lateral walls.

With this arrangement, the connecting pin can be prevented from dropping off by the shaft hole thus closed with the cover member. Moreover, since the cover member is provided to the shaft hole, the shaft hole can also be made less noticeable in appearance, thereby improving design of the slider.

The cover member may be resin-made or metallic.

In the slider in the above arrangement, it is preferable that the bottom edge point is located at a position on an imaginary straight line connecting an upper edge, which is located on an upper periphery of the outer side surface and above the top edge point, to the top edge point or is located at a position outer in the width direction with respect to the imaginary straight line.

With this arrangement, for instance, as compared with a case where the bottom edge point is located at an inner side than the bottom edge point on the opening of the shaft hole, since a distance from the top edge point to the bottom edge point in the width direction becomes longer, a region in the width direction of the guide surface for guiding the connecting pin can be widened, so that insertability of the connecting pin is improvable.

According to another aspect of the invention, a slide fastener includes: the slider according to the above aspect of the invention; and a pair of fastener stringers connected to the slider.

The slide fastener according to the above aspect of the invention can exhibit the same effects as those of the slider described above.

According to the above aspects of the invention, a resin-made slider capable of reducing a thickness thereof and improving assemblability thereof, and a slide fastener including the slider can be provided.

BRIEF DESCRIPTION OF DRAWING(S)

DESCRIPTION OF EMBODIMENT(S)

Arrangement of Exemplary Embodiment(S)

An exemplary embodiment(s) of the invention will be described below with reference to attached drawings.

Figure 1:
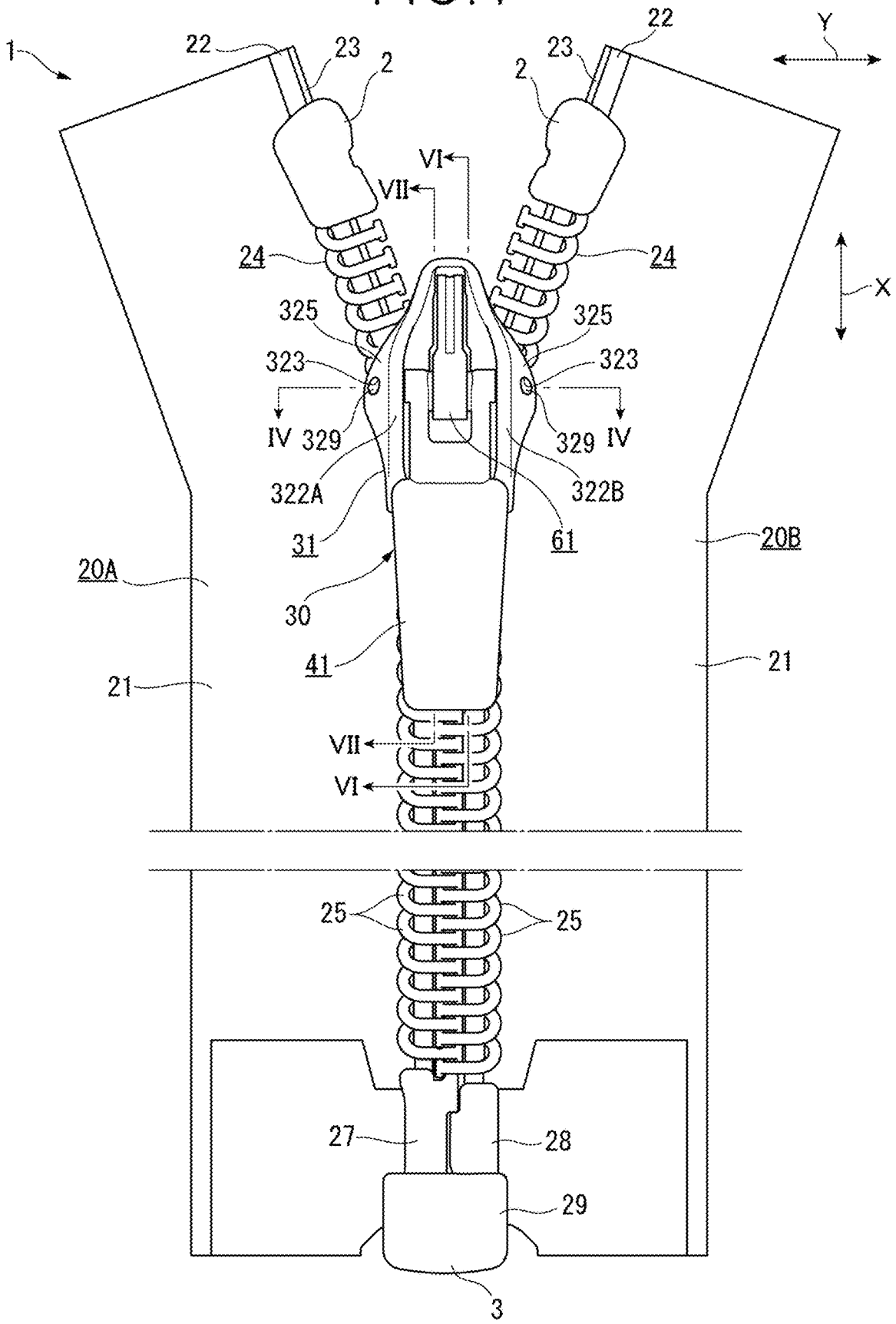
FIG. 1 is a front elevational view showing a slide fastener according to an exemplary embodiment of the invention.

As shown in FIG. 1, a slide fastener 1 according to the exemplary embodiment includes a pair of first fastener stringer 20A and second fastener stringer 20B, and a resin-made slider 30 connecting the first fastener stringer 20A to the second fastener stringer 20B.

In the description below, a longitudinal direction of the slide fastener 1 is defined as an X direction, a width direction of the slide fastener 1 is defined as a Y direction, and a thickness direction of the slide fastener 1 is defined as a Z direction. It should be noted that the X-, Y-, and Z-axis directions are orthogonal to each other.

The first fastener stringer 20A includes: a tape portion 21 extending in the X-axis direction; an element array 24 provided along a side periphery 22 of the tape portion 21; and a code core 23 provided to the side periphery 22 of the tape portion 21. The element array 24 includes a plurality of resin-made linear fastener elements 25 arranged in the X-axis direction. The linear fastener elements 25 are sewn to the tape portion 21 with a sewing thread.

The first fastener stringer 20A includes: a top stop 2 at an upper end of the element array 24 thereof; and an insert pin 27 at a lower end of the element array 24.

The second fastener stringer 20B, which includes the tape portion 21 and the element array 24 in the same manner as the first fastener stringer 20A, is paired with the first fastener stringer 20A.

The second fastener stringer 20B includes: the top stop 2 at an upper end of the element array 24 thereof; and a box pin 28 and a retaining box 29 at a lower end of the element array 24. The box pin 28, the retaining box 29, and the above-described insert pin 27 define a top stop 3. The first fastener stringer 20A and the second fastener stringer 20B are separable from each other by sliding the slider 30 down to the lowest position along the X-axis direction.

Figure 2:
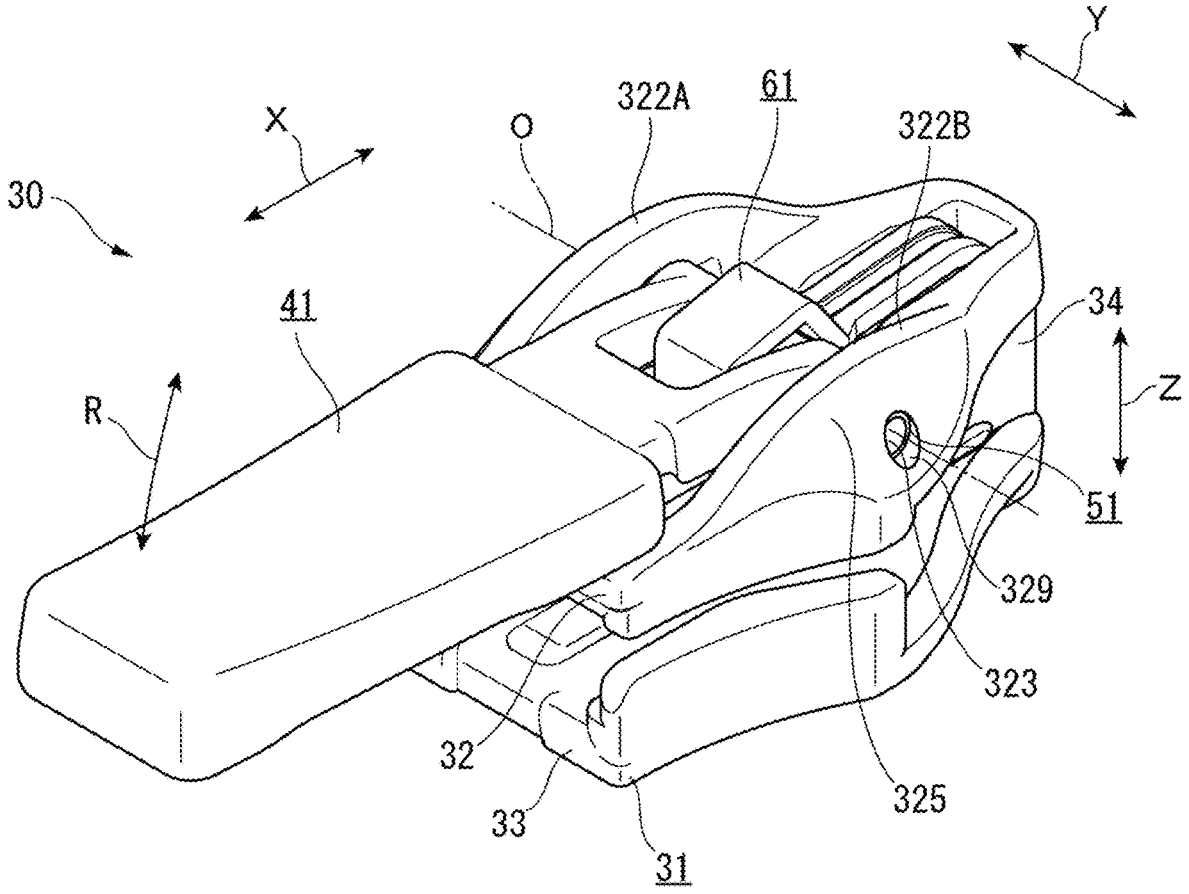
FIG. 2 is a perspective view showing a slider of the slide fastener according to the exemplary embodiment.

As shown in FIG. 2, the slider 30 includes a resin-made slider body 31, a resin-made pull tab 41, a metallic connecting pin 51, and a metallic elastic lock member 61. The slider 30, in which a position of the pull tab 41 is fixable by the elastic lock member 61, is configured so as to be locked when the pull tab 41 is laid down as shown in FIG. 2 (a longitudinal direction of the pull tab 41 is along an upper surface 321 (see FIG. 3) of the slider body 31) and to be unlocked when the pull tab 41 is raised (the longitudinal direction of the pull tab 41 is substantially perpendicular to the upper surface 321 of the slider body 31).

The slider body 31 and the pull tab 41 are provided through injection molding of a thermoplastic resin such as polyamide, polyacetal, polypropylene, and polybutylene terephthalate.

Figure 3:
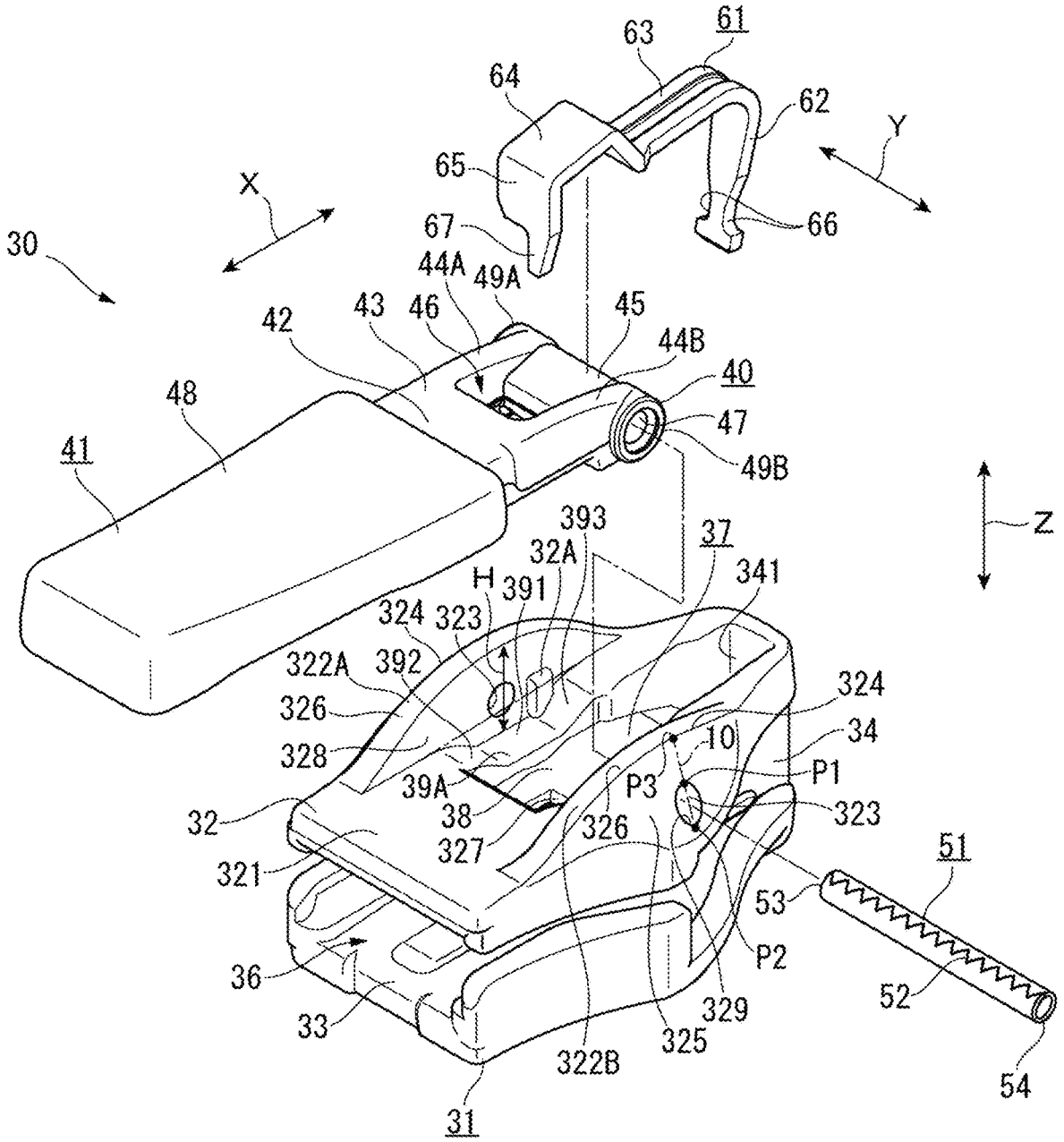
FIG. 3 is an exploded perspective view showing the slider of the slide fastener according to the exemplary embodiment.

As shown in FIG. 3, the slider body 31 includes: an upper vane 32; a lower vane 33 opposed to the upper vane 32 in the Z-axis direction; and a guide post 34 connecting the upper vane 32 with the lower vane 33. A guiding groove 36 in which each element array 24 is inserted is defined between the upper vane 32 and the lower vane 33.

An inside of the guiding groove 36 from an intermediate part to a part close to the top stop 2 in the X-axis direction (a part close to an anterior opening of the slider 30 in the X-axis direction) is divided by the guide post 34 into two (right and left) grooves in the Y-axis direction. Meanwhile, an inside of the guiding groove 36 from the intermediate part to a part close to an opener 3 in the X-axis direction (a part close to a posterior opening of the slider 30 in the X-axis direction) is a single groove continuous to the two (right and left) grooves. The guiding groove 36 is thus formed in a substantially Y shape.

The upper vane 32 is located at an upper side of each element array 24 inserted in the guiding groove 36 while the lower vane 33 is located at a rear side of each element array 24 inserted in the guiding groove 36.

The upper vane 32 includes: a pair of first lateral wall 322A and second lateral wall 322B projecting in the Z-axis direction from Y-axis directional ends of the upper surface 321; and a recess 37 that is dented from the upper surface 321 toward the lower vane 33 between the first lateral wall 322A and the second lateral wall 322B. Herein, the upper surface 321, which is a surface along a top surface of the upper vane 32 close to the posterior opening with respect to the recess 37, is shown by a chain double-dashed line in FIGS. 6 and 7 for convenience of explanation.

Figure 4:
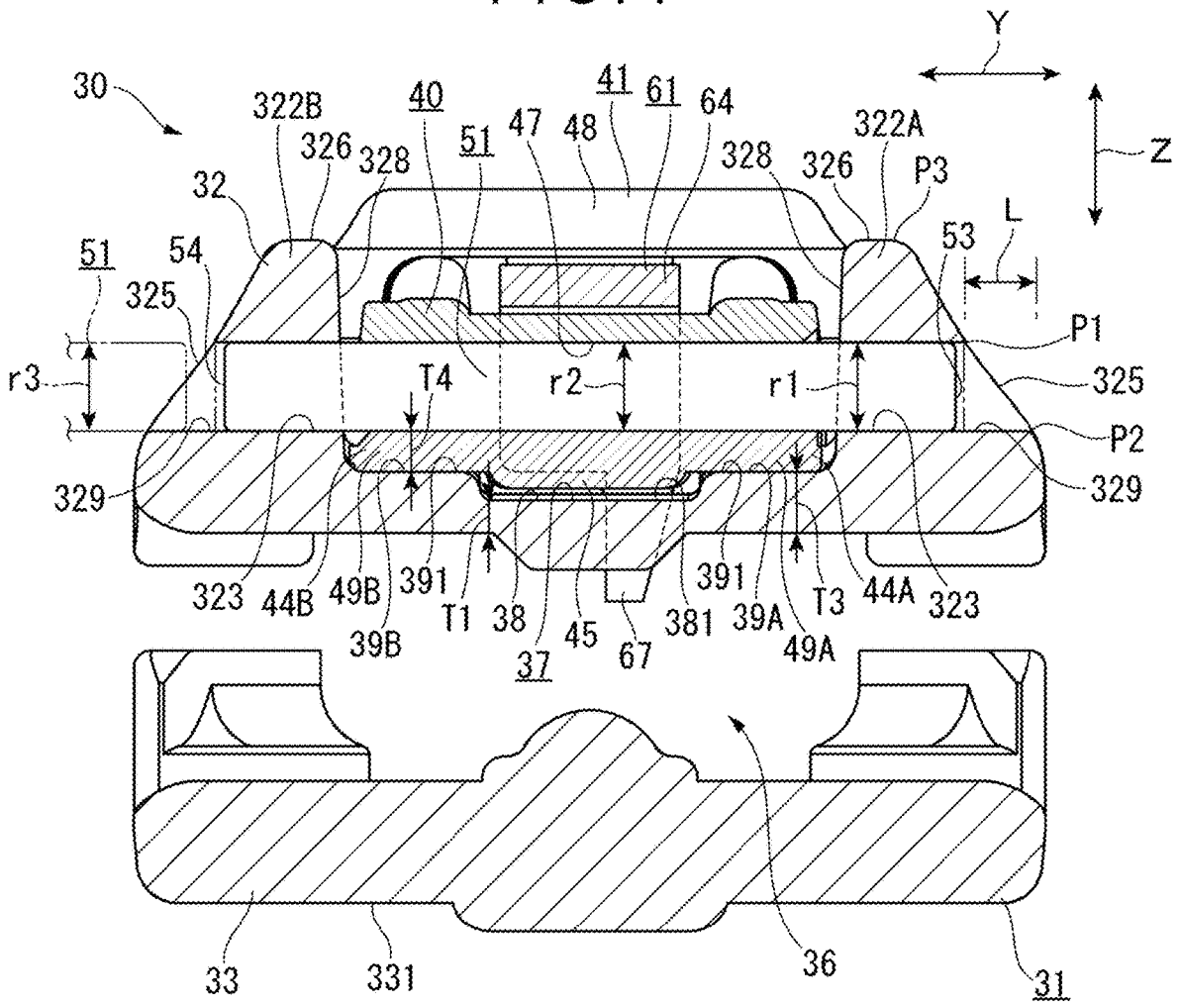
FIG. 4 is a cross sectional view taken along a IV-IV line in FIG. 1.
Figure 5:
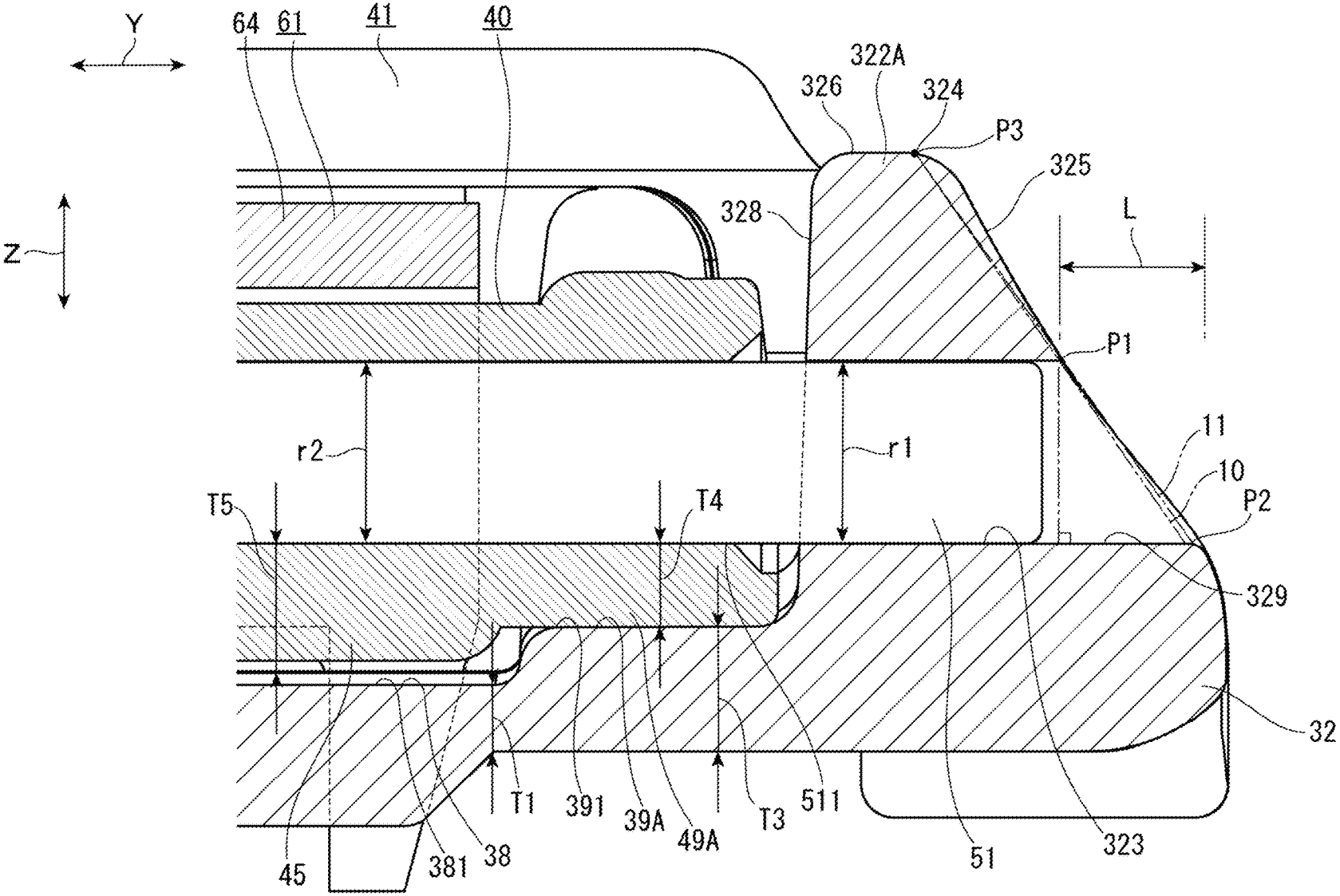
FIG. 5 is an expanded cross sectional view of a relevant part in FIG. 4.

The first lateral wall 322A includes: a cross-sectionally circular shaft hole 323 penetrating along the Y-axis direction as shown in FIGS. 4 and 5; an outer side surface 325 in the Y-axis direction; and a pull tab receptor 32A configured to receive the pull tab 41. The outer side surface 325, which is a surface of the first lateral wall 322A seen from an outside in the Y-axis direction, is inclined with respect to the Z-axis direction so as to be inclined outward in the Y-axis direction from an upper portion to a lower portion of the first lateral wall 322A in the Z-axis direction. The outer side surface 325 of the first lateral wall 322A, which is a concave curve as shown in FIG. 5, has a center of curvature (not shown) outside in the Y-axis direction with respect to the first lateral wall 322A. By thus forming the outer side surface 325 so as to be the concave curve, a bottom edge point P2 (later described) of an opening of the shaft hole 323 can be arranged at a position significantly projecting outward in the Y-axis direction with respect to a top edge point P1, so that a guide surface 329 (later described) can be enlarged in the Y-axis direction, as compared with a case where the outer side surface 325 is a convex curve.

The pull tab receptor 32A, which is in a form of projection from an inner side surface 328 of the first lateral wall 322A, is configured to be contacted with the pull tab 41 in order to position the pull tab 41 for connection to the slider body 31.

The shaft hole 323 is located at a part of the first lateral wall 322A where a height H (a Z-axis directional dimension of the first lateral wall 322A) from a recess bottom 391 of a first shoulder 39A described later to an upper end surface 326 of the first lateral wall 322A is maximized. Specifically, the shaft hole 323 is located between the recess bottom 391 of the first shoulder 39A and the upper end surface 326 in the Z-axis direction. The shaft hole 323 is opened at the inner side surface 328 and the outer side surface 325 of the first lateral wall 322A. Moreover, the shaft hole 323 is partially located lower than the upper surface 321 of the upper vane 32.

The shaft hole 323 on the outer side surface 325 has, as shown in FIGS. 4 and 5, a topmost edge denoted by a top edge point P1 on an upper side and a bottommost edge denoted by a bottom edge point P2 on a lower side in the Z-axis direction.

As shown in FIGS. 4 and 5, the bottom edge point P2 is at a position distanced outward (i.e. on a right side in FIG. 4) in the Y-axis direction from the top edge point P1 by a distance L. With this arrangement, the guide surface 329 is formed in an arc at an outer portion beyond the top edge point P1 of the shaft hole 323 in the Y-axis direction.

Moreover, as shown in FIG. 5, the bottom edge point P2 is located at an outer position in the Y-axis direction with respect to an imaginary straight line 10 connecting an upper edge P3, which is located above the top edge point P1, to the top edge point P1 on the upper periphery 324 of the outer side surface 325 (see FIG. 3). Moreover, an imaginary straight line 11 connecting the upper edge P3 to the bottom edge point P2 is more slanted with respect to the Z-axis direction than the imaginary straight line 10.

Herein, the upper periphery 324 of the outer side surface 325 in the exemplary embodiment is defined as an upper periphery of the outer side surface 325 in a lateral side view of the slider body 31. A lower periphery of the outer side surface 325 is defined as a lower periphery of the outer side surface 325 in the lateral side view of the slider body 31 and also is an outer periphery of the outer side surface 325 in a top view of the slider body 31. The upper edge P3 is a portion located above the top edge point P1 on the upper periphery 324 as described above.

Since the guide surface 329 has a guide region in the Y-axis direction corresponding to the distance L, the connecting pin 51 can be guided in the Y-axis direction along the guide region.

Since the guide surface 329 also has a guide region in a circumferential direction thereof, the connecting pin 51 can be guided along this guide region to be positioned such that an axis center O thereof is aligned with an axis center of the shaft hole 323.

With the presence of the guide surface 329, when connecting the pull tab 41 to the slider body 31 using the connecting pin 51, the connecting pin 51 can be easily positioned with respect to the first lateral wall 322A by bringing the connecting pin 51 into contact with the guide surface 329, so that the connecting pin 51 can be smoothly inserted into the shaft hole 323.

The second lateral wall 322B is structured in the same manner as the first lateral wall 322A. Accordingly, components of the second lateral wall 322B are denoted by the same reference numerals as those of the first lateral wall 322A and a detailed explanation thereof is omitted. The second lateral wall 322B is arranged in an opposite direction to the first lateral wall 322A in the Y-axis direction to be paired with the first lateral wall 322A.

The connecting pin 51 can also be easily positioned with respect to shaft hole 323 of the second lateral wall 322B by bringing the connecting pin 51 into contact with the guide surface 329 in the same manner as the above, so that the connecting pin 51 can be smoothly inserted into the shaft hole 323.

As shown in FIGS. 3 and 4, the recess 37 includes: a pair of first shoulder 39A and second shoulder 39B provided parallel in the Y-axis direction between the first lateral wall 322A and the second lateral wall 322B; and a middle recess 38 interposed between the first shoulder 39A and the second shoulder 39B, the middle recess 38 being located at the center of the upper vane 32 in the Y-axis direction. The middle recess 38 is dented in the Z-axis direction with respect to the first shoulder 39A and the second shoulder 39B and has a larger depth from the upper surface 321 than the depth of the first shoulder 39A and the second shoulder 39B. A recess bottom 381 of the middle recess 38 is provided at a position deeper than the recess bottom 391 of each of the first shoulder 39A and the second shoulder 39B (i.e. closer to the guiding groove 36).

The recess 37 is formed at a position corresponding to the entire widthwise (Y-axis directional) part of a portion (base end) of the pull tab 41 in which the connecting pin 51 is inserted.

As shown in FIGS. 3 to 6, the middle recess 38, which is formed along the X-axis direction, has a length in the X-axis direction that is approximately equal to a total X-axis directional length of an intermediate piece 63 and a contact piece 64 (later described) of the elastic lock member 61. The Y-axis directional width of the middle recess 38 is slightly larger than a Y-axis directional width of a cam 45 (later described) of the pull tab 41 and a Y-axis directional width of each of the intermediate piece 63, the contact piece 64 and an engagement piece 65 of the elastic lock member 61.

Figure 6:
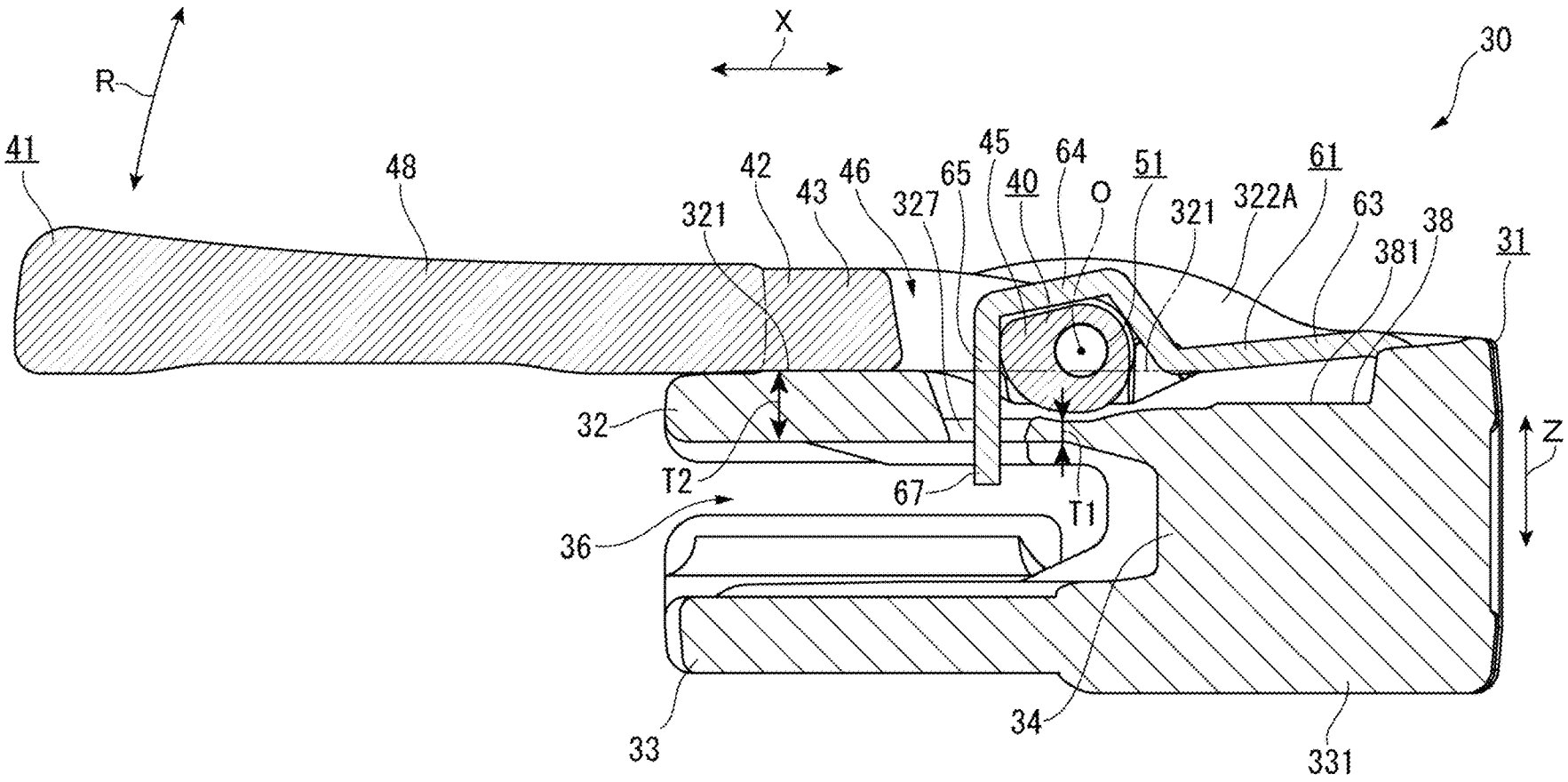
FIG. 6 is a cross sectional view taken along a VI-VI line in FIG. 1.

As shown in FIG. 6, the thinnest thickness T1 from the recess bottom 381 of the middle recess 38 to the guiding groove 36 is smaller than a thickness T2 at a part of the upper vane 32 closer to a posterior opening than the recess 37. For instance, the thickness T1 is set at 32% of the thickness T2. The thickness T1 is preferably 0.45 mm or more in consideration of the minimum strength of the middle recess 38. It should be noted that the thickness T2 is 2.5 mm in the exemplary embodiment.

The middle recess 38 is provided with a hole 327 penetrating through the slider body 31 to the guiding groove 36 at a part close to the posterior opening in the X-axis direction. Moreover, the middle recess 38 is continuous to a hole 341 (later described) of the slider body 31 close to the anterior opening in the X-axis direction.

The cam 45 of the pull tab 41 and the elastic lock member 61 are received in the middle recess 38.

As shown in FIGS. 3 to 5, the first shoulder 39A is interposed between the middle recess 38 and the first lateral wall 322A, and includes the recess bottom 391 and recess sides 392, 393 respectively provided to X-axis directional ends of the recess bottom 391.

The recess bottom 391 is provided at a position lower than the upper surface 321 of the upper vane 32 and closer to the lower vane 33 in the Z-axis direction, and provided below the shaft hole 323 of each of the first lateral wall 322A and the second lateral wall 322B (close to the lower vane 33) in the Z-axis direction.

The recess sides 392, 393 are continuous to the recess bottom 391. The recess side 392 is slanted diagonally upward from the recess bottom 391 toward the posterior opening of the slider body 31. The recess side 393 is slanted diagonally upward from the recess bottom 391 toward the anterior opening of the slider body 31.

Figure 7:
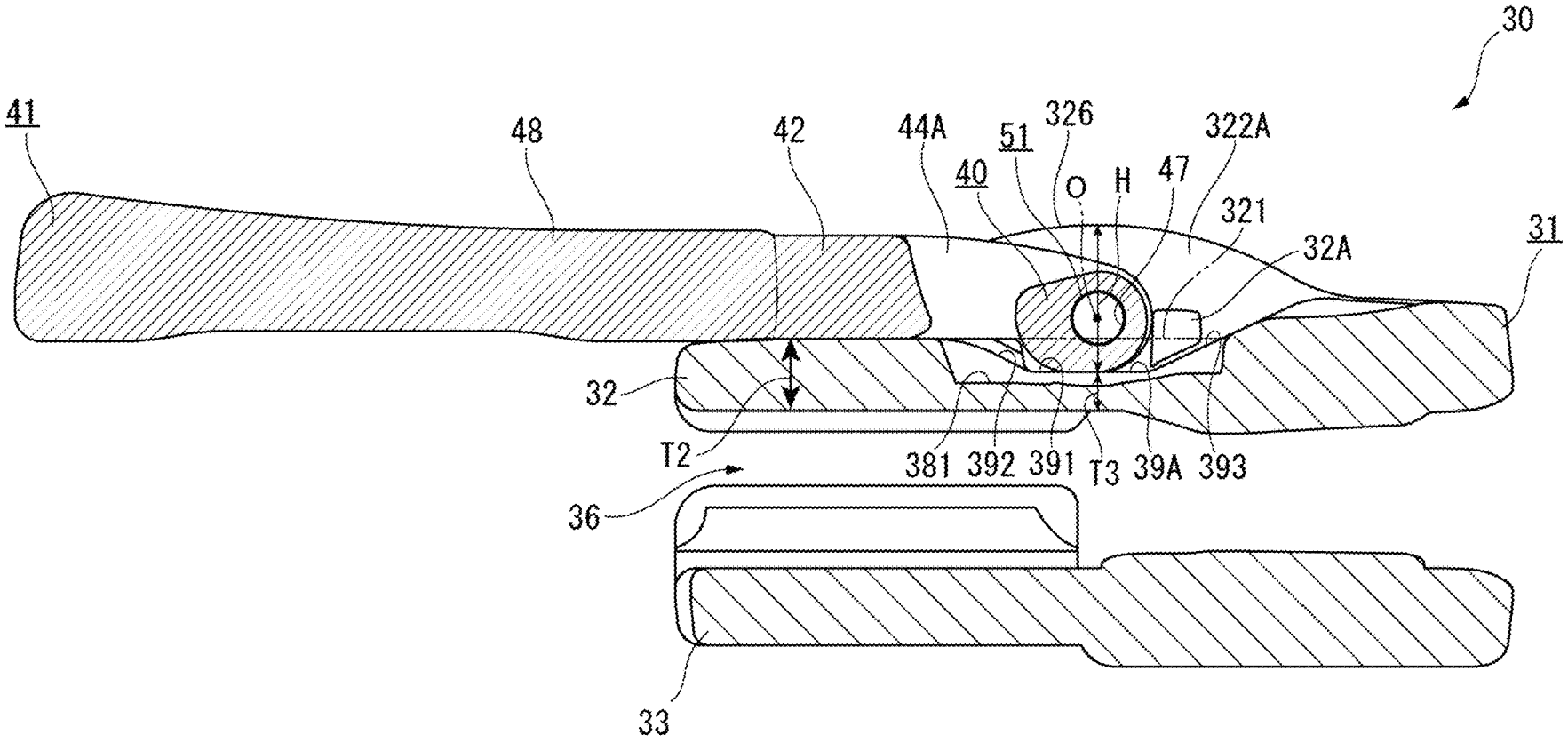
FIG. 7 is a cross sectional view taken along a VII-VII line in FIG. 1.

As shown in FIG. 7, the thinnest thickness T3 between the recess bottom 391 of the first shoulder 39A and the guiding groove 36 is smaller than the thickness T2 and is, for instance, set at 54% of the thickness T2. In consideration of the minimum strength of the first shoulder 39A, the thickness T3 may be at 15% or more, preferably from 25% to 70%, more preferably from 30% to 55%.

An end of a connection bearing 40 (later described) of the pull tab 41 inserted with the connecting pin 51 (i.e. the part of an arm 44A of the pull tab 41 provided with the shaft hole 47) is received on the first shoulder 39A.

As shown in FIG. 4, the second shoulder 39B is interposed between the middle recess 38 and the second lateral wall 322B. An end of the connection bearing 40 of the pull tab 41 inserted with the connecting pin 51 (i.e. the part of the arm 44B of the pull tab 41 provided with the shaft hole 47) is received on the second shoulder 39B. The second shoulder 39B is structured in the same manner as the first shoulder 39A. Accordingly, components of the second shoulder 39B are denoted by the same reference numerals as those of the first shoulder 39A and a detailed explanation thereof is omitted.

The guide post 34 has a hole 341 (see FIG. 3) that is opened on the upper surface 321 (top surface) of the upper vane 32 and a lower surface 331 (rear surface) of the lower vane 33. An engagement projection (not shown) to be engaged with an engagement recess 66 (later described) is formed in the hole 341.

As the slider 30 is slid downward in the Z-axis direction, the guide post 34 separates, while guiding, the respective element arrays 24 of the first fastener stringer 20A and the second fastener stringer 20B to disengage the engagement of the element arrays 24.

The pull tab 41 includes: a pull tab base 42 connected to the slider body 31 through the connecting pin 51; and a pull tab holder 48 continuous to the pull tab base 42.

The pull tab base 42 includes: a continuous portion 43 continuous to the pull tab holder 48; a pair of arms 44A and 44B extending in the X-axis direction from Y-axis directional ends of the continuous portion 43; and the cam 45 continuous to the arms 44A and 44B. The continuous portion 43, the arms 44A and 44B, and the cam 45 define an opening 46. The cam 45 has a projection toward the continuous portion 43. The shaft hole 47 is formed penetrating the arms 44A, 44B and the cam 45 in the Y-axis direction.

Since the pull tab base 42 is interposed between the first lateral wall 322A and the second lateral wall 322B and the connecting pin 51 is inserted in the shaft hole 47, the pull tab 41 is pivotally supported by the slider body 31 in a manner to be rotatable around the axis center O in an R direction.

The cam 45 and side bearings 49A, 49B of the arms 44A, 44B continuous to the cam 45 form the connection bearing 40. The connection bearing 40 is located in the recess 37 between the first lateral wall 322A and the second lateral wall 322B. Specifically, the side bearings 49A, 49B are located above the shoulders 39A, 39B while the cam 45 is located above the middle recess 38. The shaft hole 47 penetrates through the side bearings 49A, 49B and the cam 45. A Z-axis directional thickness T4 of each of the side bearings 49A, 49B between the recess bottom 391 of the shoulders 39A, 39B and an outer circumferential surface 511 of the connecting pin 51 is smaller than a thickness T5 of the cam 45 between the recess bottom 381 of the middle recess 38 and the outer circumferential surface 511 of the connecting pin 51. The maximum height H of each of the first lateral wall 322A and the second lateral wall 322B is larger than the maximum diameter of the connection bearing 40.

The connecting pin 51, which is a hollow cylinder, is provided by a slitted pin having a slit groove 52 (see FIG. 3) extending along an axial direction of the connecting pin 51. The slit groove 52 is defined by both edges of the connecting pin 51 in a circumferential direction. Both the edges are concave and convex to become inseparable in an axial direction of the slit groove 52. The connecting pin 51 is elastically deformable by a groove width of the split groove 52 in the circumferential direction thereof so that the diameter of the connecting pin 51 is reducible. Both the ends 53, 54 of the connecting pin 51 in the axial direction are rounded to improve the insertability into the shaft hole 323.

As shown in FIG. 4, the connecting pin 51 is inserted into the shaft hole 323 of each of the first lateral wall 322A and the second lateral wall 322B and the shaft hole 47 of the pull tab 41.

Herein, in the exemplary embodiment, a diameter r2 of the shaft hole 47 is slightly smaller than a diameter r1 of each shaft hole 323 and a diameter r3 of the connecting pin 51 when not inserted is slightly larger than the diameter r2 and approximately the same as the diameter r1. With this arrangement, the connecting pin 51, which is inserted while being pressed against the shaft hole 47 to be reduced in diameter, is fixed to the shaft hole 47 of the pull tab 41 in a manner rotatably supported by the shaft hole 323 of the slider body 31. By setting the diameter r2 of the shaft hole 47 of the pull tab 41 to be smaller than the diameter r1 of the shaft hole 323 of the slider body 31, the thickness of the pull tab 41 required to form the shaft hole 47 can be set to be smaller than an exemplary case where the diameter r2 is set to be larger than the diameter r1. The thickness of the entire slider 30 can be easily reduced by the reduced amount of the thickness of the pull tab 41.

By inserting the connecting pin 51 in this manner, the pull tab 41 is connected to the slider body 31 in a manner to be rotatable in the R direction. The pull tab 41 can be rotated from a rotation position shown in FIG. 2 (a lock position described later) to a position where the arms 44A and 44B are brought into contact with the recess side 393 (see FIG. 7).

The elastic lock member 61 includes: a holding piece 62 extending in the Z-axis direction to be held by the slider body 31; the intermediate piece 63 being continuous to the holding piece 62 and extending in the X-axis direction; the contact piece 64 being continuous to the intermediate piece 63 and provided surrounding the cam 45 of the pull tab 41; and the engagement piece 65 being continuous to the contact piece 64 and extending in the Z-axis direction toward the guiding groove 36.

The holding piece 62 is inserted in the hole 341 of the slider body 31. The engagement recess 66 is formed in the holding piece 62 and is engaged with an engagement projection (not shown) formed in the hole 341 of the slider body 31.

An engaging claw 67 projecting through the hole 327 of the upper vane 32 into the guiding groove 36 is formed at an end of the engagement piece 65.

The elastic lock member 61 is held in the slider body 31 by engaging the engagement recess 66 of the holding piece 62 with the engagement projection formed in the hole 341 of the slider body 31 and inserting the engaging claw 67 of the engagement piece 65 into the hole 327 of the upper vane 32. At this time, the intermediate piece 63 is located in the middle recess 38 and the contact piece 64 is located surrounding the cam 45 of the pull tab 41.

As shown in FIG. 2, when the pull tab 41 is elastically biased by the elastic lock member 61 to be in the lock position in which the pull tab 41 is laid along the upper surface 321 of the slider body 31, the engaging claw 67 is engaged with the linear fastener elements 25 while projecting into the guiding groove 36. This engagement restricts the sliding movement of the slider 30 in the X-axis direction.

Moreover, when the pull tab 41 is operated to be rotated in the R direction from the lock position against the elastically biased elastic lock member 61 and is positioned to an unlock position where the pull tab 41 stands substantially vertically on the upper surface 321 of the slider body 31, the contact piece 64 of the elastic lock member 61 is kept pushed up by the cam 45, whereby the engaging claw 67 is separated from the linear fastener elements 25. By this operation, the engaging claw 67 and the linear fastener elements 25 are disengaged, so that the slider 30 can be slid in the X-axis direction.

Further, when the pull tab 41 is operated to be rotated in the R direction from the unlocked position to the locked position, the elastic lock member 61 elastically biases the cam 45 while recovering from the elastically deformed state, thereby rotating the pull tab 41 to the locked position, so that the sliding movement of the slider 30 in the X-axis direction is restricted again.

Effects of Exemplary Embodiment (1-1) In the exemplary embodiment, the slider 30 includes: the resin-made slider body 31 having a pair of first lateral wall 322A and second lateral wall 322B projecting from the upper surface 321; the pull tab 41 interposed between the first lateral wall 322A and the second lateral wall 322B in the width direction (Y-axis direction) of the slider body 31 across which the first lateral wall 322A and the second lateral wall 322B are provided opposing each other; and the metallic connecting pin 51 connecting the pull tab 41 to the first lateral wall 322A and the second lateral wall 322B so that the pull tab 41 is rotatable in the R direction. Each of the first lateral wall 322A and the second lateral wall 322B has the shaft hole 323 and the pull tab 41 has the shaft hole 47. The shaft holes 323 and 47 are formed along the width direction (Y-axis direction) and receives the connecting pin 51 therein. The shaft hole 323 of each of the first lateral wall 322A and the second lateral wall 322B is open on the outer side surface 325 of each of the first lateral wall 322A and the second lateral wall 322B. In the opening of the shaft hole 323, the bottom edge point P2, which is at a lower position in the Z-axis direction, is located at an outer position in the Y-axis direction than the top edge point P1 that is above the bottom edge point P2 in the Z-axis direction.

With this arrangement, since the pull tab 41 is rotatably connected to the resin-made slider body 31 by the metallic connecting pin 51, as compared with an exemplary resin-made pull tab having a shaft supported by the slider body 31, the connecting pin 51 having a smaller diameter than that of the shaft is usable, so that the thickness of the slider 30 is reducible by an amount of the reduction in the diameter of the connecting pin 51.

Further, since the bottom edge point P2 is at the outer position in the Y-axis direction than the top edge point P1 in the opening of the shaft hole 323 on the outer side surface 325, the guide surface 329 can be formed at an outer part in the Y-axis direction than the top edge point P1 in the opening of the shaft hole 323 on the outer side surface 325. With this arrangement, by bringing the connecting pin 51 into contact with the guide surface 329 when inserting the connecting pin 51 into the first lateral wall 322A or the second lateral wall 322B, the connecting pin 51 can be easily positioned with respect to the first lateral wall 322A or the second lateral wall 322B, so that assemblability of the slider 30 is improvable.

(1-2) The outer side surface 325 of the first lateral wall 322A is a concave curve and has the center of curvature outside in the Y-axis direction with respect to the first lateral wall 322A.

Accordingly, for instance, as compared with a case where the outer side surface 325 of the first lateral wall 322A is formed so as to be a convex curve, a distance from the top edge point P1 to the bottom edge point P2 in the Y-axis direction becomes longer, allowing a wider region in the Y-axis direction of the guide surface 329 for guiding the connecting pin 51, so that insertability of the connecting pin 51 is improvable. It should be noted that the outer side surface 325 of the second lateral wall 322B may be formed to be a concave curve in the same manner as described above.

(1-3) The connecting pin 51 is rotatably connected to the first lateral wall 322A and the second lateral wall 322B. The pull tab 41 is fixed to the connecting pin 51.

With this arrangement, the connecting pin 51 is prevented from dropping off since being fixed to the pull tab 41 while the connecting pin 51 can rotate the pull tab 41 with respect to the slider body 31 since the connecting pin 51 is rotatably connected to the slider body 31.

(1-4) The pull tab 41 is provided with the shaft hole 47 through which the connecting pin 51 is inserted. The connecting pin 51 has a hollow cylindrical shape and has the split groove 52 extending along the axial direction thereof. The diameter r2 of the shaft hole 47 is smaller than the diameter r3 of the connecting pin 51.

The connecting pin 51, whose diameter r3 is slightly larger than the diameter r2 of the shaft hole 47 but is elastically reducible in the circumferential direction due to the presence of the slit groove 52, can be inserted into the shaft hole 47 while the diameter of the connecting pin 51 is reduced, thus being prevented from dropping off. The resin-made slider 30, unlike a metallic slider, cannot be caulked on the end of the connecting pin 51 in order to be prevented from dropping off. However, the connecting pin 51, which is provided with the slit groove 52 in the exemplary embodiment, can be easily prevented from dropping off simply by being inserted into the shaft hole 47.

Moreover, since the diameter r2 of the shaft hole 47 of the pull tab 41 is small, the thickness of the pull tab 41 required for forming the shaft hole 47 can be reduced, thereby reducing the thickness of the entire slider 30 by an amount of the reduction in the thickness of the pull tab 41.

(1-5) The shaft hole 323 formed in the first lateral wall 322A is located at a part of the first lateral wall 322A, where the height H of the slider body 31 is maximum. The shaft hole 323 formed in the second lateral wall 322B is located at a part of the second lateral wall 322B, where the height H of the slider body 31 is maximum.

Accordingly, while the height H of each of the first lateral wall 322A and the second lateral wall 322B is restricted so as not to increase the thickness of the slider body 31, a strength required at the part of each of the first lateral wall 322A and the second lateral wall 322B where the shaft hole 323 is formed can be secured.

Moreover, since the shaft hole 47 of the pull tab 41 is located between the first lateral wall 322A and the second lateral wall 322B at the part having the maximum height H, the thickness of the part of the pull tab 41 where the shaft hole 47 is formed can be maintained without being thinned, while restricting the thickness of the slider 30.

(1-6) The bottom edge point P2 is located at the outer position in the Y-axis direction with respect to the imaginary straight line 10 connecting the upper edge P3, which is located above the top edge point P1, to the top edge point P1 on the upper periphery 324 of the outer side surface 325.

Accordingly, for instance, as compared with a case where the bottom edge point P2 of the opening of the shaft hole 323 is at an inner position in the Y-axis direction than the top edge point P1, the distance L from the top edge point P1 to the bottom edge point P2 in the Y-axis direction becomes lengthened, allowing a wider region in the Y-axis direction of the guide surface 329 for guiding the connecting pin 51, so that insertability of the connecting pin 51 is improvable.

(2-1) In the exemplary embodiment, the slider 30 includes: the slider body 31 including the upper vane 32 and the lower vane 33 which are mutually connected by the guide post 34; and the pull tab 41 connected to the slider body 31, in which the upper vane 32 has a pair of lateral walls 322A, 322B projecting from the upper surface 321 of the upper vane 32 in the thickness direction of the slider body 31 defined by the opposing upper vane 32 and lower vane 33; the pull tab 41 has the connection bearing 40 in which the connecting pin 51 supported by the pair of lateral walls 322A, 322B is inserted; the upper vane 32 has the recess 37 dented toward the lower vane 33 beyond the upper surface 321 in the thickness direction of the slider body 31; and the connection bearing 40 is located in the recess 37 between the lateral walls 322A, 322B.

As compared with an exemplary case where the pull tab is located in the recess whose bottom is flush with the upper surface of the upper vane as disclosed in Patent Literature 1, the connection bearing 40 of the pull tab 41, which is located in the recess 37 dented with respect to the upper surface 321 of the upper vane 32 according to the above arrangement, can be located closer to the lower vane 33 than the upper surface 321 of the upper vane 32, so that the thickness of the entire slider 30 in the Z-axis direction is reducible.

(2-2) The thicknesses T1, T3 from the respective recess bottoms 381, 391 of the recess 37 to the guiding groove 36 are smaller than the thickness T2 from the upper surface 321 of the upper vane 32 to the guiding groove 36.

Accordingly, the reduction in the thicknesses T1, T3 allows the connection bearing 40 of the pull tab 41 to be positioned close to the slider body 31, whereby the thickness of the entire slider 30 is reducible. Simultaneously, since the reduction in the thickness T2 of the upper vane 32 is not required due to the location of the connection bearing 40 of the pull tab 41 close to slider body 31, the strength of the slider body 31 can be maintained by keeping the thickness T2 of the upper vane 32.

(2-3) The shaft hole 323 in which the connecting pin 51 is inserted is formed in each of the pair of lateral walls 322A, 322B. At least one part of the shaft hole 323 is positioned lower than the upper surface 321 of the upper vane 32. Since the shaft hole 323 is at least partially positioned lower in the Z-axis direction than the upper surface 321 of the upper vane 32, the connecting pin 51 inserted in the shaft hole 323 can be located closer to the lower vane 33 than the upper surface 321 of the upper vane 32, thereby enabling further reduction in the thickness of the entire slider 30 in the Z-axis direction.

(2-4) There is provided the elastic lock member 61 configured to elastically bias the pull tab 41 toward the lock position at which the pull tab 41 is laid along the upper surface 321 of the upper vane 32 in the R direction pivoting on the axis center O of the connecting pin 51. The recess 37 is defined by the first shoulder 39A and the second shoulder 39B located at both the ends of the slider body 31 in the Y-axis direction and the middle recess 38 dented deeper than the recess bottom 391 between the first shoulder 39A and the second shoulder 39B. The elastic lock member 61 is located in the middle recess 38 in a manner to be insertable into the guiding groove 36. The recess bottom 391 of the first shoulder 39A and the second shoulder 39B is located at a position closer to the lower vane 33 than the upper surface 321 of the upper vane 32.

Accordingly, with the elastic lock member 61 for elastically biasing the pull tab 41, a lock mechanism can be provided to the slider 30, where, when the pull tab 41 is positioned to the lock position, the elastic lock member 61 is engaged with the linear fastener elements 25 of the first fastener stringer 20A and the second fastener stringer 20B passing through the guiding groove 36 of the slider body 31 for locking, and on the other hand, when the pull tab 41 is pivoted from the lock position to the unlock position, the elastic lock member 61 is retracted from the guiding groove 36 for unlocking.

Further, also in the above-described slider 30, by locating the elastic lock member 61 in the middle recess 38 and locating the connection bearing 40 of the pull tab 41 closer to the recess bottom 391 of each of the first shoulder 39A and the second shoulder 39B, the part of the connection bearing 40 can be positioned lower than the upper surface 321 of the upper vane 32, so that the thickness of the slider 30 having the lock mechanism is reducible.

(2-5) The connection bearing 40 includes the pair of side bearings 49A, 49B on and above the pair of shoulders 39A, 39B, and the cam 45 located above the middle recess 38. The elastic lock member 61 is located in a manner to be capable of elastically biasing the cam 45 toward the lock position. The connecting pin 51 penetrates the pair of side bearings 49A, 49B and the cam 45. The thickness T4 of the connection bearing 40, which is from the recess bottom 391 of each of the pair of shoulders 39A, 39B of the pair of side bearings 49A, 49B, to the outer circumferential surface 511 of the connecting pin 51 is smaller than the thickness T5 of the connection bearing 40 from the recess bottom 381 of the middle recess 38 of the cam 45 to the outer circumferential surface 511 of the connecting pin 51.

With this arrangement, since the thickness T4 at the pair of side bearings 49A, 49B is made smaller by a certain amount than the thickness T5 of the cam 45 in the connection bearing 40 of the pull tab 41, the pair of the shoulders 39A, 39B can be positioned higher by the certain amount while the pull tab 41 is kept close to the upper vane 32, thereby facilitating enlarging the thickness T3 of the part of the upper vane 32 where the shoulders 39A, 39B are formed. Accordingly, even when the recess 37 is formed in the upper vane 32 as in the invention, the reduction in the strength of the upper vane 32 can be restricted.

(2-6) The maximum height H of the pair of the lateral walls 322A, 322B from the recess bottom 391 of the pair of shoulders 39A, 39B in the thickness direction of the slider body 31 is larger than the maximum diameter of the connection bearing 40.

Accordingly, the connection bearing 40 can be received between the lateral walls 322A, 322B without enlarging the projecting dimension of the lateral walls 322A, 322B projecting from the upper surface 321 of the upper vane 32.

(2-7) The first shoulder 39A and the second shoulder 39B each include the recess bottom 391 and the pair of recess sides 392, 393 provided on both the X-axis directional ends of the recess bottom 391. The first lateral wall 322A and the second lateral wall 322B each have the shaft hole 323 in which the connecting pin 51 is inserted. The recess bottom 391 of each of the first shoulder 39A and the second shoulder 39B is located lower than the shaft hole 323 (closer to the lower vane 33) of each of the first lateral wall 322A and the second lateral wall 322B in the Z-axis direction.

Accordingly, since the connection bearing 40 of the pull tab 41 is located at the deepest part of each of the first shoulder 39A and the second shoulder 39B, the thickness of the slider 30 is further reducible.

(2-8) Since the pull tab 41 is rotatably connected to the resin-made slider body 31 by the metallic connecting pin 51, as compared with an exemplary resin-made pull tab having a shaft supported by the slider body 31, the connecting pin 51 having a smaller diameter than that of the shaft is usable, so that the thickness of the slider 30 is reducible by the reduced amount in the diameter of the connecting pin 51.

(2-9) Since the height H of each of the first lateral wall 322A and the second lateral wall 322B is a dimension not from the upper surface 321 of the upper vane 32, but from the recess bottom 391, which is closer to the lower vane 33 than the upper surface 321, to the upper end surface 326, for instance, the height H of each of the first lateral wall 322A and the second lateral wall 322B can be set larger as compared with a case where the height is a dimension from the upper surface 321 to the upper end surface 326. Accordingly, since the larger height H is obtained while the thickness of the entire slider 30 is kept from being enlarged, the elastic lock member 61 can be made so as not to project upward beyond the first lateral wall 322A and the second lateral wall 322B and the elastic lock member 61 (functional component) can be protected by the first lateral wall 322A and the second lateral wall 322B.

Modification(s)

The invention is not limited to the above-described exemplary embodiments but may include any modifications not hampering the achievement of the object of the invention.

In the above exemplary embodiment, the recess bottom 391 of each of the first shoulder 39A and the second shoulder 39B is located lower in the Z-axis direction than the shaft hole 323 of each of the first lateral wall 322A and the second lateral wall 322B However, for instance, in some embodiments, the recess bottom 391 is located slightly offset toward the recess side 392 or the recess side 393 in the X-axis direction.

Moreover, the recess sides 392, 393, which are slanted as described above, may be designed otherwise in some embodiments (e.g. as a surface along the Z-axis direction).

The connecting pin 51 in the above exemplary embodiment, which is fixed to the pull tab 41 by being pressure-contacted with the shaft hole 47 after being elastically reduced in diameter and inserted into the shaft hole 323, is not necessarily configured as in the exemplary embodiment.

Figure 8:
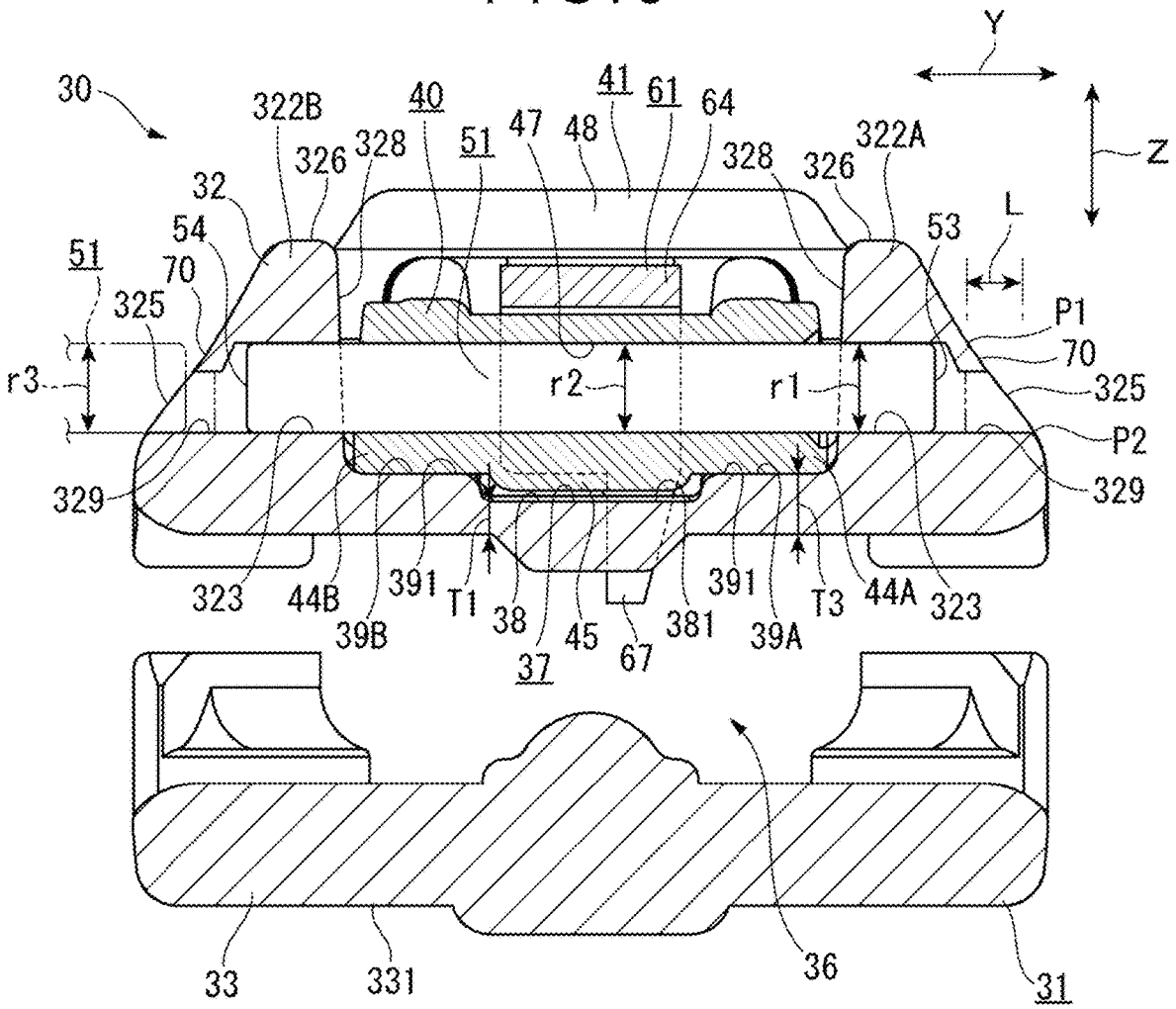
FIG. 8 is a cross sectional view showing a relevant part of a first modification of the invention.

For instance, as in a first modification shown in FIG. 8, at least one opening of the shaft holes 323 of the first lateral wall 322A and the second lateral wall 322B may be closed by a melt part 70 of the lateral wall 322A (322B). The connecting pin 51 can be prevented from dropping off by thus closing the opening of the shaft hole 323 with the melt part 70. Since the shaft hole 323 is closed by the melt part 70 of the lateral wall 322A (322B), the shaft hole 323 can be made inconspicuous in appearance. In addition, the melt part 70 per se, which closes the shaft hole 323 and is made of the same material as the material of other parts, can also be made less noticeable in appearance, thereby improving design of the slider. In this case, a connecting pin without the slit groove 52 may be used.

Figure 9:
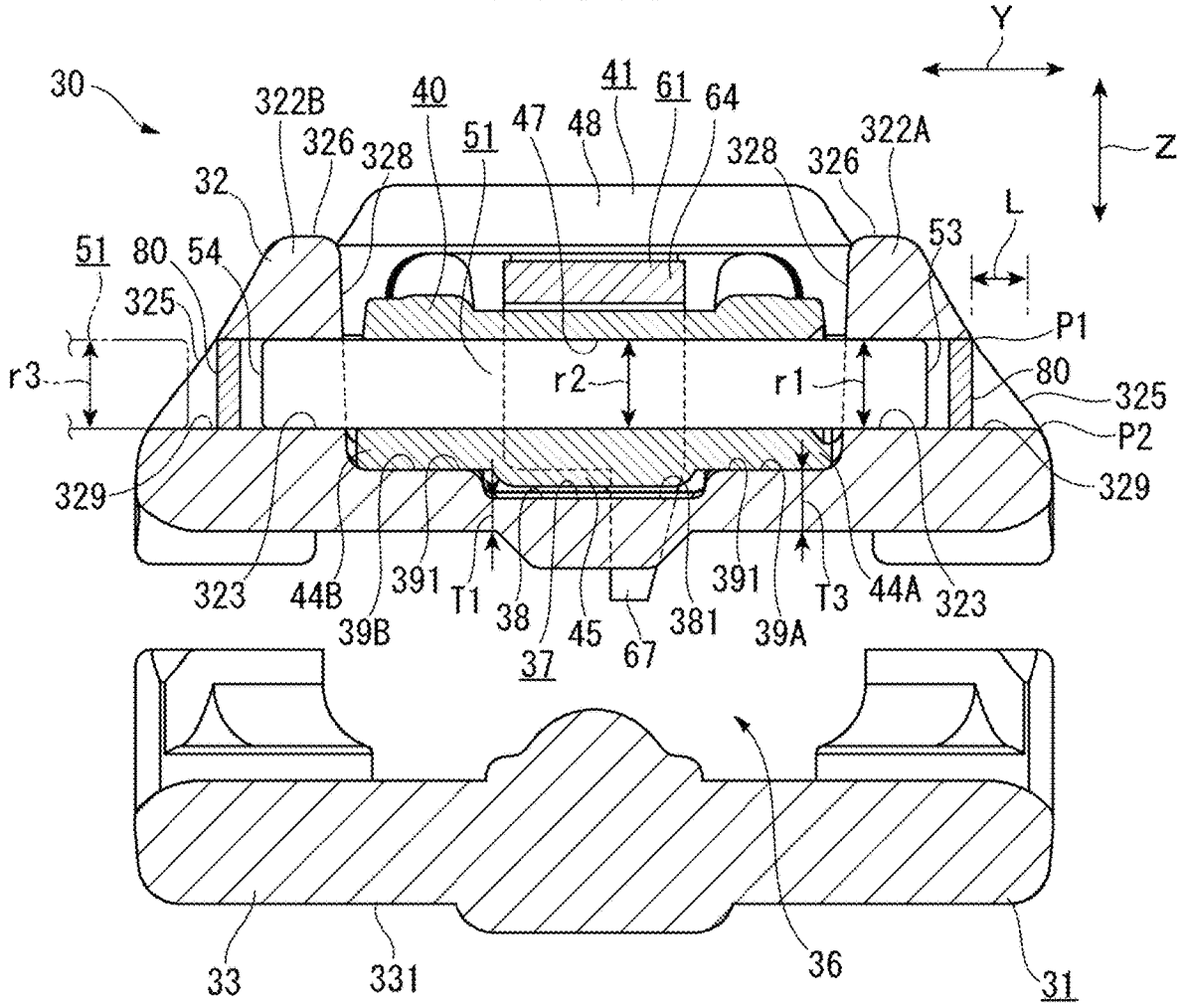
FIG. 9 is a cross sectional view showing a relevant part of a second modification of the invention.

Moreover, as in a second modification shown in FIG. 9, at least one of the shaft holes 323 of the first lateral wall 322A and the second lateral wall 322B may be closed by a cover member 80. In this case, the connecting pin 51 can be prevented from dropping off by the cover member 80. Moreover, since the cover member 80 is provided to the shaft hole 323, the shaft hole 323 can also be made less noticeable in appearance, thereby improving design.

The cover member 80 may be fixed to the shaft hole 323 by press-fit. However, a part of the first lateral wall 322A and/or the second lateral wall 322B may be melted to fix the cover member 80 to the shaft hole 323. The cover member 80 may be resin-made or metallic.

In the above first and second modifications, since the connecting pin 51 can be prevented from dropping off with use of the melt part 70 of the lateral wall 322A (322B) or the cover member 80, the slit groove 52 is not necessarily formed in the connecting pin 51. The diameters r1, r2 of the respective shaft holes 323,47 may be approximately the same as or slightly larger than the diameter r3 of the connecting pin 51 and the connecting pin 51 may be rotatably connected to both of the pull tab 41 and the lateral wall 322A (322B).

Further, the shaft hole 323 may be formed in only one of the first lateral wall 322A and the second lateral wall 322B, and the connecting pin 51 may be inserted into the shaft hole 323 and the shaft hole 47 of the pull tab 41 to connect the pull tab 41 to the slider body 31. Also in this case, the shaft hole 323 may be closed by the melt part or the cover member 80.

In the above exemplary embodiment, the recess 37 is dented from the upper surface 321 of the upper vane 32. However, in place of the recess 37, as in a third modification shown in FIG. 10, a hole 35 may be formed penetrating the upper vane 32 from the upper surface 321 of the upper vane 32 to the guiding groove 36. The connection bearing 40 of the pull tab 41 may be located in the hole 35 between the first lateral wall 322A and the second lateral wall 322B. In other words, a part of the connection bearing 40 may be positioned inside the hole 35.

Figure 10:
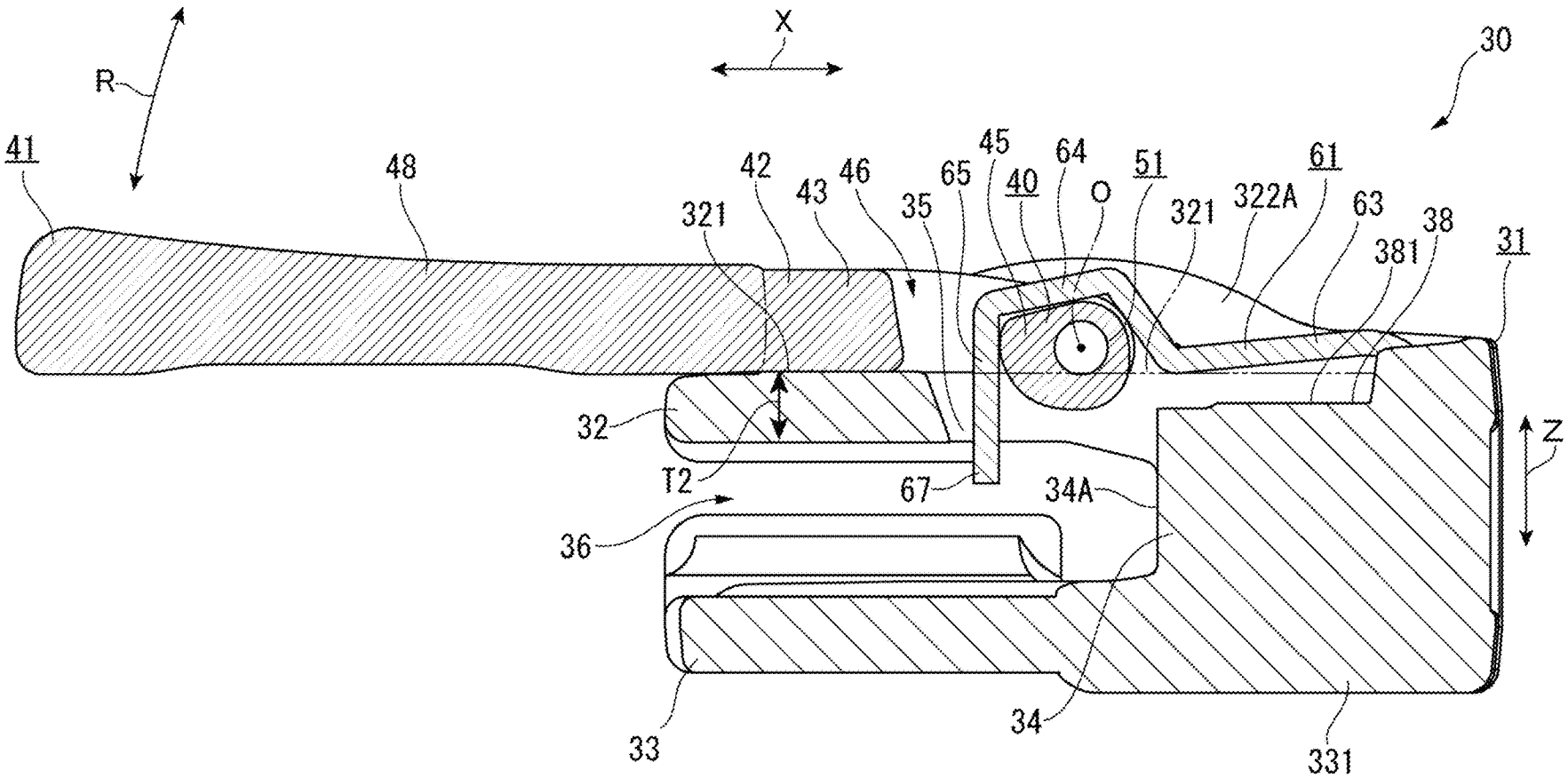
FIG. 10 is a cross sectional view showing a relevant part of a third modification of the invention.

The hole 35 shown in FIG. 10, which is an enlarged with respect to the hole 327, is enlarged to a position along the end surface 34A of the guide post 34 close to the posterior opening in the X-axis direction and to the inner side surface 328 of each of the first lateral wall 322A and the second lateral wall 322B in the Y-axis direction. By thus forming the hole 35, even if the connection bearing 40 of the pull tab 41 is located closer to the lower vane 33 than the upper surface 321 of the upper vane 32, the upper vane 32 can be kept from interfering with the connection bearing 40.

Also in the third modification, the connection bearing 40 can be located closer to the lower vane 33 than the upper surface 321 of the upper vane 32, thereby allowing the reduction in the thickness of the entire slider 30 in the Z-axis direction.

The outer side surface 325, which is formed on each of the first lateral wall 322A and the second lateral wall 322B in the above exemplary embodiment, may be formed on only one of the first lateral wall 322A and the second lateral wall 322B. Also in this case, the connecting pin 51 can be guided along the guide surface 329 by inserting the connecting pin 51 from one of the first lateral wall 322A and the second lateral wall 322B where the outer side surface 325 is formed.

In the above exemplary embodiment, the connecting pin 51 is fixed to the pull tab 41 and the first lateral wall 322A and the second lateral wall 322B are rotatably connected to the connecting pin 51. However, any other arrangement is possible. For instance, the connecting pin 51 may be fixed to the first lateral wall 322A and the second lateral wall 322B and the pull tab 41 may be rotatably connected to the connecting pin 51.

In the above exemplary embodiment, the diameter r2 of the shaft hole 47 of the pull tab 41 is smaller than the diameter r1 of the shaft hole 323 of each of the first lateral wall 322A and the second lateral wall 322B and the diameter r3 of the connecting pin 51. However, for instance, in some embodiments, the diameter r1 of the shaft hole 323 of each of the first lateral wall 322A and the second lateral wall 322B may be smaller than the diameter r2 of the shaft hole 47 of the pull tab 41 and the diameter r3 of the connecting pin 51. In this case, the connecting pin 51 is brought into pressure contact with the shaft hole 323 of each of the first lateral wall 322A and the second lateral wall 322B to be fixed to the pull tab 41 while being rotatably connected to the shaft hole 47 of the pull tab 41.

Alternatively, the connecting pin 51 is brought into pressure contact with the shaft hole 323 of only one of the first lateral wall 322A and the second lateral wall 322B to be fixed thereto while being rotatably connected to the shaft hole 47 of the pull tab 41 and the other of the first lateral wall 322A and the second lateral wall 322B.

In the above exemplary embodiment, the slit groove 52 is formed along both uneven edges of the connecting pin 51 in the circumferential direction. However, for instance, the slit groove may be formed of edges extending straight along an axial direction of the connecting pin 51.

In the above exemplary embodiment, the shaft hole 323 is located at the part of each of the first lateral wall 322A and the second lateral wall 322B, where the height H from the recess bottom 391 to the upper end surface 326 of the slider body 31 is the maximum. However, for instance, in some embodiments, the shaft hole 323 is located at a part offset in the X-axis direction.

In the above exemplary embodiment, the element array 24 includes a plurality of linear fastener elements 25 as described above. However, the arrangement of the element array 24 is not limited thereto. The element array 24 may be in any other shapes and/or include various elements (teeth) such as resin-made elements and metallic elements.

In the above exemplary embodiment, the slide fastener 1 includes the opener 3 capable of separating the first fastener stringer 20A and the second fastener stringer 20B from each other by sliding down the slider 30 to the lowest position. However, any other arrangement is possible. For instance, in some embodiments, the opener 3 is replaced by a bottom stop. Even when the slider 30 is slid down, the slider 30 is stopped by the bottom stop to make the first fastener stringer 20A and the second fastener stringer 20B inseparable.

In the above exemplary embodiment, the slider 30, in which a position of the pull tab 41 is fixable by the elastic lock member 61, is configured so as to be locked with the pull tab 41 being laid down as shown in FIG. 2 (the longitudinal direction of the pull tab 41 is along the upper surface 321 of the slider body 31) and to be unlocked with the pull tab 41 being raised. However, the arrangement of the slider 30 is not limited thereto. For instance, the slider 30 may be a slider having a lock mechanism, in place of the elastic lock member 61, in which the engaging claw 67 to be engaged with the element array 24 is provided to the pull tab 41, or may be a slider having no lock mechanism (i.e. without the elastic lock member 61 and the like).

When the lock mechanism is not provided to the slider 30, the elastic lock member 61, the middle recess 38 and the holes 327, 341 of the slider body 31 are omitted. Accordingly, the recess bottoms 381, 391 of the recess 37 may be flush with each other, and the thickness T1=T3 may be established.

The outer side surface 325, which is a concave curve in the above exemplary embodiment as shown in FIGS. 4 and 5 is configured otherwise in some embodiments as long as being capable of guiding the connecting pin 51 (e.g. a convex surface or a flat surface (not curved)).

Moreover, a part of the outer side surface 325 may be a concave curve. In this case, the shaft hole 323 may be opened at the part that is the concave curve.

Further, although the outer side surface 325 of each of the lateral walls 322A, 322B is slanted, the outer side surface 325 is not limited thereto. For instance, in some embodiments, the outer side surface 325 has a step portion. Even in such a case, it is only required that the bottom edge point P2 is at a position outer in the Y-axis direction than the top edge point P1 to form the guide surface.

In the exemplary embodiment, the bottom edge point P2 of the opening on the outer side surface 325 of the shaft hole 323 is located at a position outer in the Y-axis direction with respect to the imaginary straight line 10 connecting the upper edge P3 of the outer side surface 325 and the top edge point P1 of the opening. However, any other arrangement is possible. It is only required that the bottom edge point P2 is located at a position in a range where the guide surface 329 for guiding the connecting pin 51 when inserting the connecting pin 51 can be formed. For instance, in some embodiments, the bottom edge point P2 is located at a position on the imaginary straight line 10.

The invention claimed is:

1. A slider comprising:

a resin-made slider body comprising an upper surface and a pair of lateral walls projecting from the upper surface;

a pull tab interposed between the pair of the lateral walls in a width direction of the slider body in which the pair of the lateral walls are opposed to each other, wherein at least a part of an outer side surface of at least one of the lateral walls is a concave curve whose center of curvature is located outside the at least one of the lateral walls in the width direction; and a metallic connecting pin connecting the pull tab to the pair of the lateral walls so that the pull tab is rotatable, wherein the pull tab and the at least one of the lateral walls each comprise a shaft hole that is provided along the width direction and in which the connecting pin is inserted, the shaft hole of the at least one of the lateral walls is opened on the outer side surface of the at least one of the lateral walls to define an opening, and the opening of the shaft hole is provided with a bottom edge point and a top edge point above the bottom edge point in a direction orthogonal to the width direction of the slider body, the bottom edge point being offset outward in the width direction with respect to the top edge point.

2. The slider according to claim 1, wherein the connecting pin is fixed to one of the pull tab and the pair of the lateral walls, and the other of the pull tab and the pair of the lateral walls is rotatably connected to the connecting pin.

3. The slider according to claim 1, wherein the connecting pin is a hollow cylinder comprising a slit groove along an axial direction of the connecting pin, and a diameter of the shaft hole of each of the pair of the lateral walls or a diameter of the shaft hole of the pull tab is smaller than a diameter of the connecting pin.

4. The slider according to claim 1, wherein the shaft hole is formed in each of the pair of the lateral walls, the shaft hole being located at a part of each of the pair of the lateral walls where a height is at a maximum.

5. The slider according to claim 1, wherein the shaft hole is formed in each of the pair of the lateral walls to define respective openings therein, at least one of the openings being closed by a melt part of the lateral walls.

6. The slider according to claim 1, wherein the shaft hole is formed in each of the pair of the lateral walls, and the slider comprises a cover member disposed in the shaft hole of at least one of the pair of the lateral walls.

7. The slider according to claim 1, wherein the bottom edge point is located at a position on an imaginary straight line connecting an upper edge, which is located on an upper periphery of the outer side surface and above the top edge point, to the top edge point or is located at a position outer in the width direction with respect to the imaginary straight line.

8. A slide fastener comprising:

the slider according to claim 1; and a pair of fastener stringers connected to the slider.

* * * * *